US005373657A

United States Patent [19]

Betz et al.

[11] Patent Number: 5,373,657

[45] Date of Patent: Dec. 20, 1994

[54] SIGHT APPARATUS FOR FIREARMS

[75] Inventors: Robert C. Betz, Worthington; John S. Thomas, Columbus, both of Ohio

[73] Assignee: Progenics Corporation, Columbus, Ohio

[21] Appl. No.: 155,949

[22] Filed: Nov. 19, 1993

Related U.S. Application Data

[62] Division of Ser. No. 914,257, Jul. 15, 1992, Pat. No. 5,279,061.

[51] Int. Cl.[5] ..... F41G 1/46

[52] U.S. Cl. ..... 42/100

[58] Field of Search ..... 42/100, 101, 102, 103

[56] References Cited

U.S. PATENT DOCUMENTS

| | | | |
|---|---|---|---|
| 3,495,338 | 2/1970 | Ullman | 42/100 |
| 4,112,583 | 9/1978 | Castilla | 42/100 |
| 4,458,436 | 7/1984 | Bohl | 42/100 |
| 4,733,490 | 3/1988 | Mulawski | 42/100 |
| 4,815,822 | 3/1989 | Bramhall | 42/100 |

*Primary Examiner*—David Brown
*Attorney, Agent, or Firm*—Mueller and Smith

[57] ABSTRACT

A sight apparatus is formed of a small housing having a curved top and an internally disposed chamber which is intended to be positioned generally at the location of a normal front sight as used with firearms intended for shooting remote targets. The housing incorporates a switchable light emitter such as an LED of substantial brightness which is positioned adjacent a small collimation chamber and exit aperture pointed parallel with the gun barrel axis toward the shooter's eye station. The brightness of this emitter output is selected with respect to the brightness of the ambient suround about the target so as to achieve enhanced brightness contour via physiological lateral inhibition within the shooter's eye. There then results a sharp sighting imagewhich represents gun tip positional data to the shooter. This data is available to the shooter even though both eyes are focused at the remote field of the target, generally at infinity, and defocused at the tip of the gun barrel.

4 Claims, 4 Drawing Sheets

SIGHT APPARATUS FOR FIREARMS

This application is a division, of application Ser. No. 07/914,257, filed Jul. 15, 1992, now U.S. Pat. No. 5,279,061.

BACKGROUND

There are various sports which require a shooter to hit a moving target with a shotgun including skeet, trap, sporting clays, and hunting. Since their inception, these sports have become increasingly popular throughout the United States. Skeet was developed between 1910 and 1915. Today, there are 17,000 members in the National Skeet Shooting Association, the governing body of all skeet shooting in the United States. Trap shooting originated in the 1700's, currently the Amateur Trap Shooting Association, which serves as governing body for all registered trap shoots, has 100,000 members. Sporting clays developed in England in 1925. After a slow start, the sport has made its greatest gains in popularity in England in the last 20 years and in the U.S. in the last 5–8 years. Finally, hunting has always been a very popular sport. In 1989, the U.S. Fish and Wildlife Service estimated there were 15,858,063 licensed hunters, it is safe to say that hunting is one of the most popular sports in the United States today.

Beginners participating in these shotgun shooting sports quickly discover that hitting a moving target is extremely difficult. Generally, a shotgun has a smoothly bored barrel with a relatively large inner diameter as compared to a rifle. A shotgun shell houses a group of small, metal pellets called shot. Once fired, as the shot leave the barrel they spread somewhat and travel in a stream-like fashion, much like a stream of water from a garden hose. This stream-like pattern, called a shotstring, makes it easier to hit a moving target, the shooter need only catch the target in the spread out stream of shot as opposed to hitting the target with a single projectile. Generally, a shotgun is pointed, by experienced shooters at a target using a smooth, practical rhythm of motion. A small, steel or plastic bead sight attached to the muzzle of the gun typically is provided as a reference device in pointing the shotgun at the target.

To shoot a shotgun one must mount the shotgun correctly. When mounting a shotgun, the shooter brings the butt-end of the stock to the shoulder and the side to the face so the eye which is closest to the stock looks directly over the top of and down the barrel of the shotgun along what may be detained a "sight axis" across the small bead sight mounted, on the muzzle of the gun. Once the shotgun is properly mounted, preferably, the head does not move with respect to the gun. This keeps the shotgun in the same position in relation to the shooter's eye and enables the use of a consistent body position as a reference as to where the gun is pointed while visually focusing and concentrating on the moving target.

The shooter should always keep both eyes open and focused at the far, target field to obtain a wider range of vision while he is in the process of pointing the gun and shooting. This enables the shooter to sec the target for a longer period of time and thus devote more concentration on the target. A shooter attempting to hit a moving target while using only one eye greatly restricts his vision and ability to hit moving targets. The most difficult problem encountered by clay target shooters, hunters, and other sportsmen engaged in shooting sports involving a moving target is that of opposite eye dominance. An opposite eye dominant shooter who attempts to shoot with both eyes open will experience a totally inappropriate gun-target picture. Thus, a right-hand shooter who is left eye dominant cannot shoot with both eyes open, putting him at a definite disadvantage. A variety of products that block part of the shooter's opposite dominant vision are currently on the market, these involve placing optical discs or other objects on the shooter's glasses. While this technique is helpful, it is only a partial solution. The shooter still suffers from partially blocked vision and is now subject to an additional distraction from necessary attention to the target.

In skeet, targets called "birds" are thrown or propelled from mechanical or electrical "traps" at about 75 miles per hour from a pair of houses spaced approximately thirty-seven yards apart, the low house and the high house. The low house ejects targets from a lower position than the high house and the targets intersect near the same point in the middle of the field. Thus, targets thrown from the low house travel in a steeper trajectory than targets thrown from the high house, which travel in a relatively flat trajectory. The shooter shoots at a target thrown from the low house and the high house from each of a group of eight stations positioned in a semi-circle. At stations one, two, six and seven, the shooter also shoots at a double, which consists of a pair of targets released simultaneously, one from the high house and one from the low house. In order to hit a target, the shooter must lead the target to compensate for speed, angle and distance. To obtain a proper lead, the shooter must concentrate intensely on the target, yet know where the bead on the end of his shotgun is as a reference as to where the gun is pointed. There are three methods of obtaining the proper lead to successfully hit a skeet target: the pass through, the acceleration and the sustained lead method. In using the pass through method, the shooter starts the gun behind the target, swings the gun and overtakes or passes through the target and fires. To successfully break a target using the pass through method the shooter must concentrate on the target and pass the small bead sight on the muzzle of the shotgun through the target. The second method of shooting a skeet target is the acceleration method. In this method, the shooter points the gun directly at the target and follows it through the air. When he is ready to shoot he accelerates the gun in front of the target and fires. To successfully break a target using the acceleration method the shooter must place the bead at the muzzle of the shotgun on the target and track the target with the sight before accelerating the gun to shoot the target. Finally, the third and currently considered most accurate method of shooting a skeet target is the sustained lead method. Using this method, the movement of the gun is started simultaneously at target release and the shooter maintains a constant lead in front of the target, Ewing at the target at anytime during its flight. At each station of a skeet field, there is a unique, predetermined amount of lead that must be taken to break the target. To successfully break a target using the sustained lead method the shooter must concentrate on the target yet remain aware of the orientation of the barrel of the shotgun as a reference point to verify that the correct lead has been taken to break the target. In effect, to utilize any of the above sighting methods, the shooter must concentrate on the target while somehow remaining aware of the location of the tip of the barrel of his shotgun.

Trap, like skeet, is a shooting sport in which a shooter tries to hit targets propelled into the air at about 75 miles per hour. However, in trap, the targets are thrown away from the shooter at five different angles from a pit located below ground level in the middle of the field. Shooting from five successive stations positioned in an arcuate row behind the pit, the shooter must lead each target to compensate for speed, angle, and distance. Essentially, the same three methods for obtaining the proper lead to successfully hit a skeet target as described above; the pass through, acceleration and sustained lead method, are used in trap. The most popular being the pass through method. Thus, as in skeet, to properly sight a trap target the shooter must concentrate intensely on the target yet constantly know where the bead sight is as a reference as to where the gun is pointed.

In sporting clays, which is designed to simulate actual hunting conditions, targets are usually thrown in a wooded setting at a higher rate of speed than trap or skeet targets, come in five different sizes and are painted either orange, white, yellow, or black. The shooter must shoot at the targets, which are released as either singles, following pairs, report doubles or true doubles from various stations, however the gun cannot be mounted until the target is thrown and becomes completely visible. If the shooter mounts the gun too quickly, a referee calls "no target" and the target is thrown again. Should the shooter persist in mounting the gun too quickly, the referee calls the target "lost" and the target is not thrown again. Because of the varied background created by the woods and other natural settings, the speed, size and various colors of the targets, complete concentration on the target in sporting clays is of the utmost importance. As in trap or skeet, in sporting clays a shooter must lead the target to compensate for speed, angle, and distance. Generally, the same methods of obtaining the proper lead to successfully hit a skeet target are used in sporting clays. The pass through and acceleration methods can be used in sporting clays and are carried out in much the same manner as described in conjunction with skeet. Similar to the sustained lead method used in skeet, the "move, mount and shoot" method can be utilized in sporting clays. When the shotgun is unmounted the muzzle of the gun is maintained ahead of the target as the target is thrown. The gun is mounted and a proper lead unique to the shooting station and the type of target being thrown is determined and the target is fired upon. For success in sporting clays, the move, mount and shoot method, which mandates that the target be tracked with the muzzle of the gun before the shotgun is mounted, is a must. The woods, background color, the speed, and various colors and sizes of the clay targets are all factors that make it very difficult to track a sporting clays target. Thus, a great deal of concentration or cognition must be devoted to the target, which makes it more difficult to keep track of the orientation of the barrel as a reference of where the gun is pointed.

Hunting can be a most frustrating and difficult shooting sport. Many factors hamper a hunter's ability to shoot game. The target, an animal, is usually naturally camouflaged, thus difficult to see, and almost always moves in an unpredictable path at unpredictable speeds. Wooded areas which provide a dark, cluttered background and open fields which may provide a bright, cloudy, or dark background may also hamper a shooter's ability to track game. Thus, it is important that the hunter devote full concentration on the target while knowing where the end of his shotgun is as a reference of where the gun is pointed. Unfortunately, in a hunting environment, the small bead sight on the end of a shotgun generally will be defocused and further difficult to locate as a reference point because of background conditions and a great variety of other factors.

Other lesser known shotgun sports such as tower shoots, flushes, crazy quail and quail walks, or the more internationally known sports of Olympic Trap and Skeet, pigeon shooting and driven pheasants import all the principals of obtaining a proper lead and concentrating on a moving target while remaining aware of gun orientation as described in conjunction with skeet, trap, sporting clays and hunting.

SUMMARY

The present invention is addressed to sight apparatus and the associated method wherein the sighting of firearms with respect to moving remote targets may be improved. The apparatus provides a small, controlled columnated light beam along a sight axis which is directed toward the shooter's eye position. Emanating from a small exit aperture, the light at the sight is of an intensity ,selected with respect to ambient brightness to achieve an enhanced brightness contrast. That phenomenon, then evokes a brightness contour in the manner of a Mach band which, as mentally perceived, is sharp and distinct, although entirely a product of the retinal nerve system, i.e. physiological lateral inhibition. Instantaneous gun barrel tip positional data thus is perceived by the shooter even though both eyes are focused at far field or infinity for cognition of or attention to target position and flight characteristics. For typical daylight shooting, the sight apparatus employs a somewhat bright light emitting diode in the red region of the spectrum. Alternately, for variations in the color and brightness of the ambient surround, lumination in different parts of the spectrum are employed at different intensities to achieve the noted lateral inhibition and permit full attention and fax field focus on the part of the shooter at the remote target itself.

As another aspect of the invention, the problem of opposite eye dominance, particularly with shotgun shooters is addressed. By combining the sight apparatus of the invention with a sight blocking arrangement, the eye dominance difficulty can be readily accommodated and effectively overcome.

Another feature of the invention provides sight apparatus for aiming a firearm at a remote target within a region exhibiting given ambient brightness, the firearm having a barrel extending along a central axis substantially from a shooter's eye position to a forwardly disposed tip. The apparatus comprises a sight housing mountable in the vicinity of the barrel tip which has an internally disposed chamber and extends along a sight axis parallel to the central axis toward the eye position to a light exit aperture of select peripheral cross sectional diameter. The housing has an edge region of predetermined dimension surmounting the exit aperture. An emitter of light is mounted within the sight housing chamber which is electrically energizable to generate a light output of predetermined brightness intensity in the visible spectrum which is at the shooter eye position only as it is emitted through the exit aperture. The exit aperture principal cross sectional dimension and the emitter predetermined brightness intensity are selected to evoke physiological lateral inhibition mechanisms and attendant brightness contour with respect to the ambient brightness as perceived by the shooter when the eye is focused on the remote target.

Another feature of the invention provides an illumination assembly for use with the battery of given outer diameter and having a centrally disposed rod-shaped electrode extending outwardly from the forward face thereof, the assembly being subject, in use, to dynamic shock.

As another feature, the invention provides a method for aiming a firearm at a remote target moving within an ambient surround of given brightness, the firearm having a barrel extending to a tip region within a near field of view of a shooter's eye when positioned for aiming and the target being within a remote field of view of said shooter's eye, comprising the steps of:

providing a sight housing mounted upon the barrel at the tip region, the housing having an internally disposed chamber and extending along a sight axis substantially parallel with the barrel to a light exit aperture of select cross-sectional dimension;

positioning an emitter of light in the visible spectrum within the sight housing chamber energized to generate a light output of predetermined brightness intensity visually perceptible at the shooter's eye only as it is emitted through the light exit aperture, the light output brightness intensity and the light exit aperture dimension being selected to evoke at the shooter's eye an enhanced brightness contour with respect to the ambient brightness;

observing the target by focusing the shooter's eye upon the target within the remote field of view while the sight is sharpened in contour by physiological lateral inhibition at the near normally unfocused field of view;

simultaneously aiming the barrel at the remote target; and simultaneously firing the firearm at the target.

Another feature of the invention provides a sight assembly for occluding the view of the front sight apparatus of a firearm from the dominant eye of an opposite-eye-dominant shooter. The sight assembly comprises a thin, vertically disposed vane mounted adjacent to and near the front sight apparatus in a manner to block the front sight apparatus from the sight of the dominant eye of an opposite-eye-dominant shooter.

The invention, accordingly, comprises the apparatus and method possessing the construction, combination of elements, arrangement of parts, and steps which are exemplified in the following detailed disclosure.

For a fuller understanding of the nature and objects of the invention, reference should be had to the following detailed description taken in connection with the accompanying drawings.

DETAILED DESCRIPTION OF THE INVENTION

In the discourse to follow, the dynamics involved with the sport of skeet shooting are discussed in connection with a diagram of a skeet field. While the sight apparatus of the instant invention has application to essentially all shooting sports, and to the use of firearms in security and law enforcement operations, the sighting demands imposed upon a typical skeet shooter provide a helpful basis in an understanding of the sighting solutions now posed. Then the discourse turns to a general implementation of the sight apparatus in conjunction with an exemplary shotgun barrel and then tuns to the physiological aspects associated with the brightness contrast evoked through use of the sight. The discussion then turns to an arrangement employing the apparatus for accommodating for shooter eye dominance problems, preferably using the sight apparatus. Finally, the description looks to preferred structural embodiment of the sight apparatus.

Figure 1:
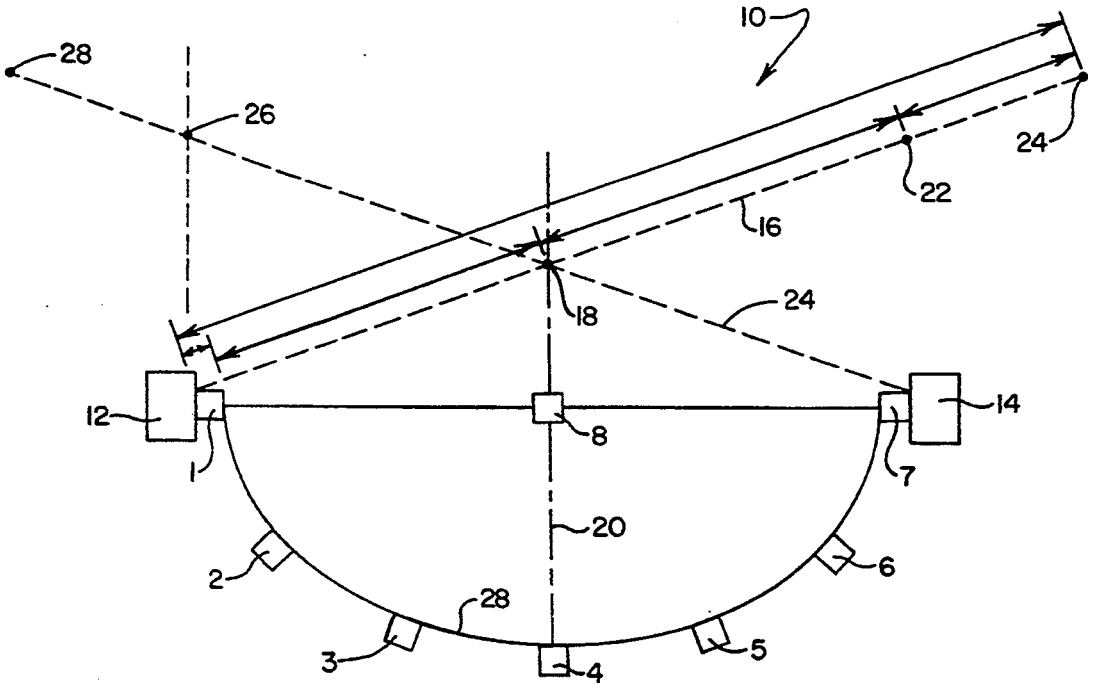
FIG. 1 is a diagrammatic view of a skeet field.

Looking to FIG. 1, a skeet field is represented generally at 10. The skeet field 10 will have two "houses", a high house 12, and a low house 14. Clay targets are launched from the high house 12 at a window therein from an elevation of about ten feet. These clay targets, traveling about 75 miles per hour will follow the path represented by the dashed line 16 when launched by a referee or observer at the command of the shooter. Generally that command will be the word "pull". Launching occurs as the puller or referee pushes a switch button which causes a launching mechanism to carry out the target launch. From the high house 12, the target will fly about 21 yards across to a position above a target crossing point 18 and may continue another 22 yards over a shooting boundary marker 22. Sixteen yards further along the path 16 is a target distance marker 24. Alternately or simultaneously, upon receiving a "pull" command, the puller or referee will cause the launching of a target from the low house 14 commencing at an elevation close to ground. This target will, as before, fly at about 75 miles per hour along a path represented by dashed line 24 progressing, as before, over the target crossing point 18 upon having traveled about 21 yards and then continuing for another 22 yards to cross a shooting boundary marker at an additional 22 yard range and may progress as far as a target distance marker 28 which is 16 yards further along path 24. With the skeet shooting procedure, the shooters take a shooting position at each of eight shooting positions located within an arc 28 commencing, as numbered in the drawings, with number 1 and ending with number 8. Upon giving the command "pull", the referee depresses the launching button and the shooter swings the shotgun in a smooth fashion achieving an appropriate lead where necessary as a launch initially occurs from the high house. A next command "pull" will cause the referee to push a lauch button lauching from the low house 14 and the shooter then, standing at station 1, for example, leads the target and executes appropriate follow through and attempts to hit it. At stations 1 and 2 and 6 and 7, a doubles launch occurs wherein the targets are launched simultaneously from high house 12 and low house 14. Generally, the shooter firing at "doubles" from station 1 will fire at the high house lauch target first and then "pick up" the target launched from the low house 14.

The shooters then progress along the stations varying lead and shooting techniques in accordance with given station positions. Shots taken at station 8 essentially call for hitting the target overhead.

Observing better shooters, one will notice a smooth, consistent pivoting of the body and gun, and a regular and repeatable timing and gun mounting on the pan of the shooter. In this regard, should novice pullers be utilized, the rhythm and synchronization between the shooter and the puller may be altered, a condition which often disrupts and disconcerts better skeet shooters. Thus, even the pullers are called upon to display a lauch timing talent.

The requisite timing and synchronous motion of the shooter may be described from a number of aspects, particularly those associated with the focusing capability of the human eye. As is apparent, it is necessary that the shooter maintain an attention to the small target moving at 75 mph across the target path. This target is sufficiently distanced from the shooter that the eyes of the shooter are, in general, focused at infinity, i.e. at far field. The typical shotgun will have a forward bead sight formed of metal at its barrel tip. To find and sustain an appropriate lead of the barrel axis with respect to target position, it is somehow necessary that the shooter be aware, i.e. perceive, the location of the tip of the shotgun. Optically, this would require that the shooter focus at the bead site or barrel tip, a distance often found to be about 2½ feet. An anomaly then becomes apparent. Essentially all shooters, and particularly those of advancing age, have a visual system wherein the eye is unable to accommodate focusing at the near barrel tip (near field) and simultaneously at infinity with respect to the target. Thus, better shooters will be seen to have placed their cheek against the stock of the shotgun such that their upper torso and eye station is aligned somewhat parallel with the gun axis and are thus aware of its location, and both eyes will be focused at infinity on the target. Timing synchronization then is the next talent which combines to define the better shooter. By contrast, poorer shooters will exhibit poor posture, gun position with respect to the eyes, and unsystematic erratic movement and timing.

As is apparent, were the shooter's eye capable of simultaneously focusing in the near field at the bead sight of the shotgun and at the far field watching the target, scores would improve because more accurate data is achieved through perception. In other optical perception environments, elaborate optics have been employed such that the observer at an eye station may perceive a close object image through optics focusing at infinity while simultaneously observing far objects at that same infinity focus. This approach is seen, for example, in "heads up" displays in vehicles and the like where refocused lens imaging is employed to provide a display focused at infinity, for example at the windscreen of a vehicle such that the vehical operator may observe instrument or navigational data close up while the eye is focused at infinity and still observe outside objects normally focused at infinity. Investigators, however, have found that the individual using such systems can cognitively attend to one subject in this infinity focused field or to the other, but not attend to both at the same time, given that the subject tasks differ cognitively or attentively. For example, the navigational details on a map reflected in a windshield of an automobile may distract the vehicle operator from driving to the extent of being unaware of other traffic.

The present invention will be seen to achieve accurate position data while the shooter's eyes are in focused at infinity looking to targets in the fax field. This data is achieved optically through the development of a sight which evokes a brightness contrast between the ambient environment of shooting and the tip region of the barrel of the gun being fired. The sight achieves the physiological evokation of Math bands through lateral inhibition mechanisms of the eye. Thus even though the shooting eye is defocused with respect to the tip of the gun being fired, the shooter receives and thus perceives positional data representing an accurate location of the tip of the barrel of the gun. For the accomplished, championship level shooter, this added data may improve performance, for example by one point or target, an improvement very often representing the difference between a first place in shooting contests and a lesser place. Correspondingly, for the shooter of lesser capability, the added data aids the rapidity of improvement in shooting performance.

Figure 2:
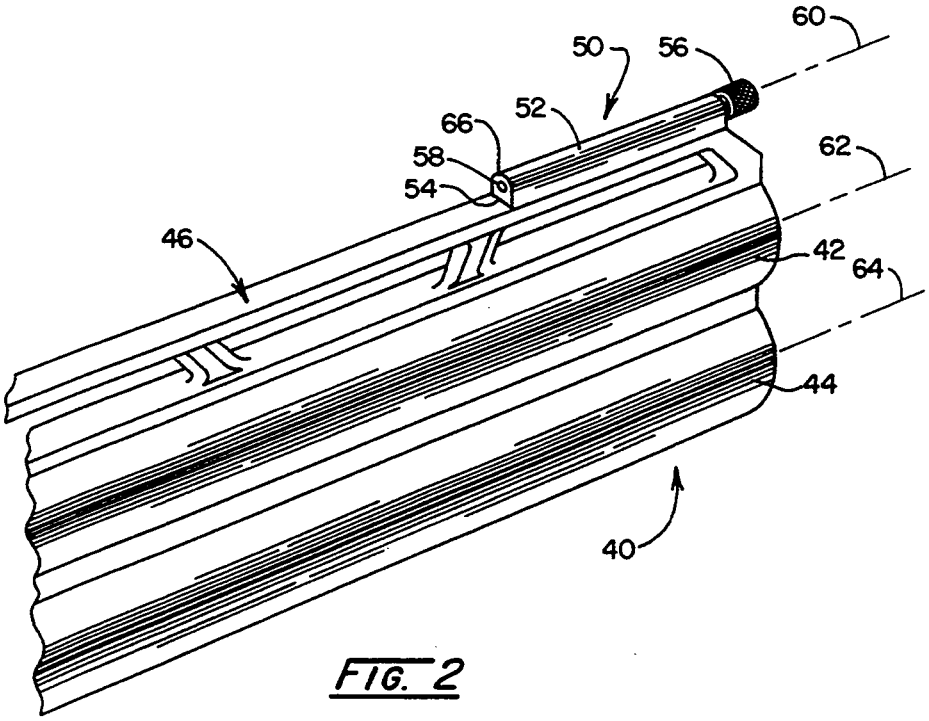
FIG. 2 is a perspective view of the forward portion of a shotgun barrel having sight apparatus according to the invention installed thereon.

Now looking to an embodiment of the invention wherein this sighting improvement is manifested, reference is made to FIG. 2 where the tip region of the barrel of a typical skeet gun is represented generally at 40. This barrel 40 is of a generally encountered "over and under" variety having two barrels 42 and 44. Along the top barrel 42 is a rib 46 down which the shooter generally sights, for example, parallel to a barrel axis of the gun. A sight apparatus 50 formed according to the teachings of the invention, is mounted upon the top flat surface of this rib 46. This sight apparatus 50 is seen to have a housing 52 with a flat bottom surface 54 which is in fixed contact with the fib 46. Generally, the surface 54 is glued by an appropriate metal to metal glue to the top of surface 46. Housing 52 is seen to have an upward cylindrical shape somewhat emulating the silhouette of a conventional bead sight which otherwise would be present at the tip region 40. Forwardly of the housing 52 is a knurled knob 56 which provides access and switching action to turn on a light emitting source retained within a chamber of the housing 52 and provide a selectively columnated light output at an exit aperture 58. The sight apparatus 50 has a sight axis represented at 60 which is generally parallel to the central axes of the barrels 42 and 44 as represented, respectively, at 62 and 64. The term, "sight axis" is intended herein to encompass the shooter eye-based orientation used when firing. It may vary, depending upon shooting technique, but will generally be parallel with the control axis or axes of a firearm. The exit aperture 58 has a selected principal cross sectional dimension or diameter and is seen to be surmounted by an edge region 66 of relatively thin width.

Housing 52 is bored to have the noted internal chamber into which the knurled knob 56 is threaded. To provide the light emitting source, within the chamber, there is positioned an illuminator assembly having a light output of predetermined intensity and spectrum at the exit aperture 48. Looking momentarily to FIG. 7A, this light output is seen to be provided by a light emitting diode (LED) represented generally at 68 having a forwardly disposed lens portion 70 which abuts against a counterbore collimation portion 72. Portion 76 serves to collimate the light output of LED 68 generally along a light path represented by the sight axis 60. In general, the LED 68 is part of an exchangeable illuminator assembly represented generally at 74 which is inserted into an internal cavity 76 of the housing 52. This internal cavity 76 is cylindrical in form and is seen also to receive a cylindrical battery 78. In this regard, the illuminator assembly 74 and the battery 78 are inserted through an opening 80 in the housing 52 which is internally threaded at 82 to receive the corresponding external screw threads 84 of the knurled knob 56. In general, as the knob 56 is tightened inwardly compelling O-ring 57 to lock knurled knob 56 against housing 52, a helical spring 86 intermediate the back side 88 of battery 78 and a cavity 90 is depressed to urge the battery 78 forwardly into an orientation causing the illumination of the LED 68. The illuminator assembly is generally configured in accordance with an illuminator assembly described and claimed in U.S. Pat. No. 5,058,900 by Denen, issued Oct. 22, 1991, entitled "General Purpose Illuminator Assembly", assigned in common herewith and incorporated herein by reference.

Returning to FIG. 2, the light output or illumination brightness evoked by light emitting from the exit aperture 58 is selected as being quite bright with respect to the brightness of the ambient surround, i.e. the skeet field, whether in sunlight conditions, overcast, or for artificially illuminated night shooting. What is developed with this arrangement is a distinct region of brightness which is contrasted with the brightness of that ambient surround, i.e. there exists a simultaneous brightness contrast. Without the benefit of earlier studies and experimentation, one would normally consider that one's conscious experience of brightness will increase as the amount of light reaching the eyes increases. However, investigators have found that perceptual experiences do not follow that logic. Despite increases in the amount of light reaching the eye, the apparent brightness of a surface may actually decrease depending upon the brightness of the background on which it rests. In effect, there is a form of spatial interaction present between adjacent retinal regions of the eye. Psychological evidence indicates that inhibitory spatial interaction does take place in the eye. In this regard:

> most of this evidence has been collected from Limulus (The Horseshoe Crab), an animal commonly found in the Eastern shores of the United States. Limuilus has several sets of eyes, but the ones that are most important for research purposes are the lateral eyes, which are faceted (as in the eye of a fly). In such a compound eye, a separate optical system exists for each facet, and each has its own primitve retina. Since each eyelet has its own optic nerve, this arrangement spreads out the neural fibers somewhat.
>
> With skill (and a dissecting microscope) it is possible to separate out a single nerve fiber, drape it over an electrode, and record its electrical activity. Much of the work on the visual system of Limulus was carded out in the laboratories of the Nobel-Prize winner K.H. Hartline and his frequent collaborator Floyd Ratliff. They were able to demonstrate the inhibitory neural interactions between nearby receptors using a very simple but elegant experiment (Hartline & Ratliff, 1957).
>
> First, they monitored the response from the cell in Limulus that is functionally equivalent to a ganglion cell, called the eccentric cell, while the receptor attached to it was simulated.

"Sensation & Perception", Third Edition by Coren and Ward, pp. 99, 100. Harcourt Brace Jovanovich, Publishers, San Diego, 1989.

Figure 3A:
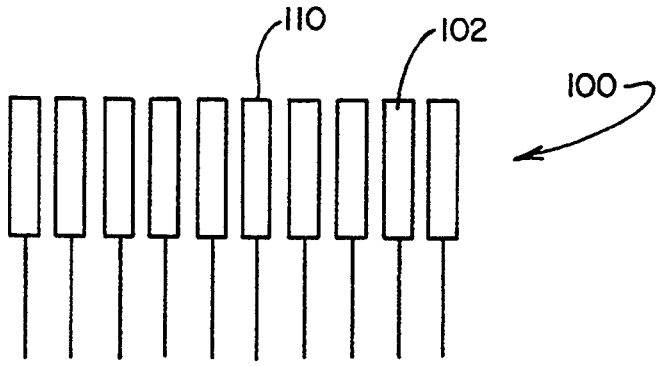
FIGS. 3A and 3B combine as a diagram for describing physiological lateral inhibition mechanisms in the course of select stimulation of horizontal eye cell components.
Figure 3B:
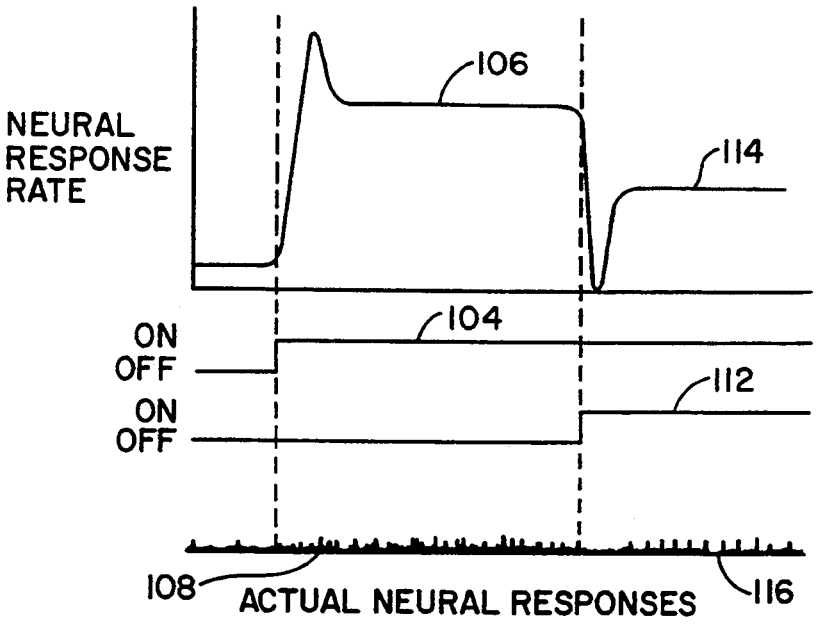

The Hartline and Ratliff investigations can be illustrated diagrammatically. Referring to FIG. 3A, laterally disposed ganglion-like cells and receptors are represented schematically at 100. By stimulating the cell 102 with light as represented by curve 104 in FIG. 3B, a neural response rate as represented by curve 106 in FIG. 3B is evoked with an actual neural response represented by the response frequency 106. If the cell 110 in FIG. 3A is stimulated with light while cell 102 is not so stimulated, then there will be no response in the ganglion cell 102. However, if cells 102 and 110 are simultaneously excited by light, at the onset of the application of light to cell 110 as represented at curve 112, there results the neural response rate 114 shown in 3B and the frequency response represented at 116. Thus, stimulating cell 110 while cell 102 is active inhibits or suppresses the response of the cell 102 because of lateral inhibition.

In discussing border contrast, lateral inhibition, Schiffman has commented:

> The enhancement of stimulus differences—border contrasts—is the result of the luminance from the different regions interacting with each other. One function of these interactions is obvious: it is an aid in the perception of borders, contours, and edges of an object even where there is not much physical difference in the light intensities between the object and its surroundings. The phenomenon of border contrast, by exaggerating the difference in the neural firing rates of receptors located in either side of the imaged boundary, enhances the perception on the contour and thereby provides a necessary step in the process of pattern recognition.

"Sensation and Perception An Integrated Approach", Third Edition, by H.R. Schiffman, John Wiley & Sons, New York, 1976, pp. 272-273.

Further commentary concerning lateral inhibition provides, for example, as follows:

> It seems, then, that the electrical activity of a Limulus photoreceptor depends not only on that photoreceptor's level of stimulation, but also on the level of stimulation of nearby photoreceptors. The more these neighboring photoreceptors are stimulated, the lower the electrical activity of the neural cell. In other words, lateral inhibition is present. The mechanism for lateral inhibition in the Limulus is the lateral plexus, a primitive net that connects the photoreceptors and allows them to influence each other's electrical activity.
>
> The human retina, although much more complex than the visual system of the Limulus, has a system of connections among photoreceptors that operates in a somewhat similar fashion . . . At a somewhat more advanced stage of visual processing, you can see that the amacrine cells connect the ganglion cells with one another and also connect bipolar cells to each other. Thus, the cells in the human retina can communicate with each other and potentially inhibit each other's electrical activity, demonstrating lateral inhibition.

Lateral inhibition might seem an inefficient process to you. After all, what purpose could be served by inhibiting the firing of adjacent receptors? Actually, lateral inhibition can serve to enhance our perception of edges and we have already discussed the importance of edges . . .

The crucial feature of lateral inhibition that needs to be stressed is that our visual system has the capacity to improve upon reality. The reality provides reasonably clear boundaries between the light and the dark . . . However, our visual system takes those reasonably clear boundaries and exaggerates them so that the dark side is even darker and the bright side is even brighter. Objects are therefore more conspicuous because their edges are intensified.

"Sensation and Perception" by M.W. Matlin and H.J. Foley, Third Edition, Allyn and Bacon, Boston, 1992.

There exists a perceptual phenomenon known as "Mach" bands. These bands are named after Ernst Mach, an Austrian physicist and philisopher who described them in 1865. The subjective contrast enhancement at contours is generally referred to as "border contrast". The enhanced regions, which occur at the points of greatest change in luminance are generally referred to as the noted Mach bands.

Now returning to the sight apparatus 50 as shown in FIG. 2, the bright collimated output from the exit aperture 58 generates a brightness region which is restricted by the exit aperture 58 and aligned with the sight axis 60. This brightness from the exit aperture 58 is perceived by the shooter in conjunction and adjacently compared with ambient brightness. Thus, a brightness contrast is evoked and, without focusing the eye at the front sight but, in fact, focusing at infinity, looking at the moving target, the shooter will perceive and receive barrel tip position data representing a sharp contour. This accurate data is developed through interlaced neural networks just beyond the receptors of the eye. Three salient points then are apparent in using the sight apparatus 50:

(1) The shooter's eyes remain focused at the remote (far field) moving target and the shooter's attention or cognitive activity is with that target.

(2) The fact that the shooter is focused at the target with both eyes results in a defocusing simultaneously with respect to the (near field) position of the tip of the gun barrel. This is simply because the human eye cannot accommodate focusing simultaneously at near and far distances.

(3) Because of the brightness contrast evoked from the sharp edge between the exit aperture 58 and environmental brightness, strong physiological mechanisms in the ganglia, e.g. in the horizontal cells of the eye, are able to create a lateral inhibition. This lateral inhibition is perceived but is something that is not physically there. The contrast or the sharpness of the location of the sight exit aperture 58 is enhanced by physiological mechanisms beyond what is visually present. The shooter by this sighting apparatus, receives additional data which could not otherwise have been achieved.

Figure 4:
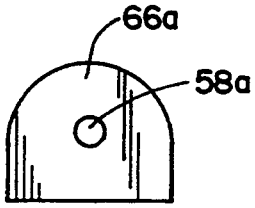
FIG. 4 is a front view showing an aperture configuration for sights described in conjunction with the invention.
Figure 5:
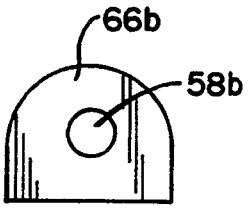
FIG. 5 is a front view showing another aperture configuration for sight apparatus according to the invention.
Figure 6:
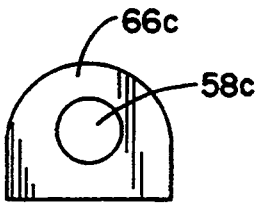
FIG. 6 is a front view showing still another exit aperture configuration for sight apparatus according to the invention.

As is apparent, for different shooting environments, the principal cross sectional dimension or diameter of the aperture 58 will vary. This variation also will occur with different forms of firearms. As seen in FIGS. 4, 5, and 6, aperture diameter variations are respectively represented at **58*a*, 58*b*, and 58*c*. These are shown in conjunction with the corresponding base width 66 shown, respectively at 66*a*–66*c*. Generally, the smaller exit apertures are employed with pistol forms of firearms and the like. For shotgun use, for example, the exit aperture will have a radius of 0.056 inch and the outer radius of the housing 52 will be 0.109 inch. The length of the columnation region or base 72 has been provided preferably having a length along the sight axis 60 of about 0.079 inch. The length of the housing 50 may vary depending upon the use at hand and length of battery employed. However, for shotgun applications in the sporting fields, a length of 1.650** inch is typical.

In practice, it has been determined that a very bright red LED 68 is preferred for daylight shooting. In particular, a double heterojunction AlGaAs high intensity red LED is desirable. Such devices, for example, are marketed as type HLMP-K105 by Quality Technologies Corporation of Sunnyvale, Calif. These LEDs, for example, exhibit a minimum luminance value of about 35 millicandellas (reed) and a typical output of about 65 mcd at an excitation of about 20 milliamperes. Of the wavelengths in the visible spectrum, the red spectrum output of such devices will range, for example, from about 590 nanometers to 690 nanometers wavelength. For shooting under artificial lights at night, empirical studies have determined that a yellow region or mid-spectral region light emitting diode is desirable. In this regard, a clear yellow type MV53622 LED made with gallium arsenide phosphide on gallium phosphide is desirable and marketed by Quality Technologies Corp. (supra). The mid-spectrum output of such a device will exhibit a wavelength value of, for example, of about 575 nanometers. For shooting under heavy overcast, twilight dusk, or against a dark background such as sporting clays in the woods, an LED in the green visible spectrum has been found to be desirable. For example, a type MV54624 (HLMP-1521) marketed by Quality Technologies Corp. (supra) has been found suitable. In general, the yellow LED identified exhibits a minimum luminance intensity at 25° C. (reed) of about 6.0 mcd and typically develops about 8.0 mcd under 20 milliamp excitation. The green spectrum device noted above typically provides a minimum luminance intensity at 25° C. (mcd) of about 6.0 mcd and a typical intensity of about 12.0 mcd under 20 milliamp excitation. The green spectral region generally will be present between wavelengths of about 490 and 550 nanometers.

Returning to FIG. 7A, the sight assembly 50 is shown in partial sectional fashion in a mode wherein it is switched off, i.e. the LED 68 is not excited. Note that when the illuminator assembly 74 is inserted into the chamber 76 of the housing 52, the forward lens 70 of LED 68 nests against the inwardly disposed edges of the collimating component 72 of the exit aperture 58. Extending from the back surface 122 of the LED 68 are two thin metal electrode pins 124 and 126. Pins 124 and 126 may have a square cross section having a principal dimension or diametric dimension, for example, of about 0.025 inch. Electrode pin 124 is shown extending rearwardly from the back surface 122 to a base position 128 and is configured thereat to define a generally circular spring or compressible switching component support base 130. The base 130 is disposed along a plane generally parallel to the back surface 122 of LED 68 or perpendicular to the sight axis 60 (FIG. 2). Electrode pin 126 is configured such that it extends to provide a mounting portion 132 which is generally coaxial with the sight axis and which extends to the center of a base opening within the support base 130. To the outwardly facing circular surface of support base 130, there is connected the base end 134 of a compressible coil switching spring or component 136. The switching end 138 of spring 136 is seen to be abuttably engaging the forward face 140 of the lithium pin battery 78. Battery 78 is configured having an external surface electrode which extends partially over the forward face 140 thereof so as to provide an electrical contact with the switching end 138 of spring 136. Extending from the center of battery 78 is a rod-shaped electrode 142 which, for the type battery illustrated, is the cathode of the device. For the application shown, the battery 78 may be provided, for example, as a type BR435 marketed by the Battery Sales Division of Panasonic Industrial Company, Division of Matsushita Electric Corporation of America. The battery has a nominal voltage of 3 volts and a nominal capacity of 50 mAh, a diameter of 4.2 mm, a height of 35.8 mm, and a weight of 0.92 g. Note that the battery 78 nests within the chamber or internal cavity 76 and that its outside diameter is essentially the same as the corresponding outside diameter of the switching spring or component 136. No permanent connection is made between the forward face 140 of the battery 78 and the switching end 138 of spring 136, thus permitting battery replacement.

Rod-shaped electrode 142 is seen aligned with and spaced just rearwardly of the wider open end of a compressible coil capture spring or capture component 144. Spring 144 may be formed, for example, of a phosphor-bronze wire and has a generally conical configuration with a constricted connecting end 146 and a wider diameter capture end 148. The connecting end 146 of spring 144 is fixed to mounting portion 132 of electrode pin 126. Preferably this connection is assured by soldering. In general, the inner diameter of connecting end 146 will correspond with the principal dimension of electrode pin 126, for example, about 0.025 inch. Spring 144 is seen to extend through the opening of base 130 formed from lead 124 to present the capture end 148 thereof at a location within spring 136 selected to permit reception of the end of red-shaped electrode 142 of battery 78.

Switching carried out, as noted above, by screwing the knob 56 inwardly to press battery 78 forward so as to compress as coil spring 86. The resultant closed circuit orientation of the components is revealed in FIG. 7B.

Figure 7A:
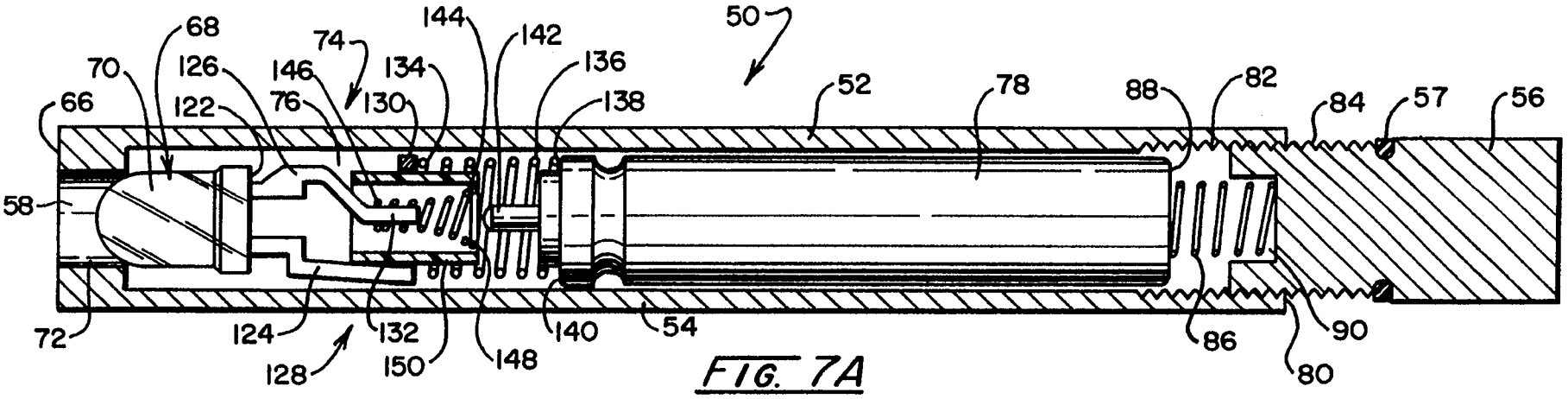
FIGS. 7A and 7B are partial sectional views of the apparatus of FIG. 2, FIG. 7A showing the apparatus in an open circuit configuration and FIG. 7B showing the apparatus in a closed circuit configuration.
Figure 7B:
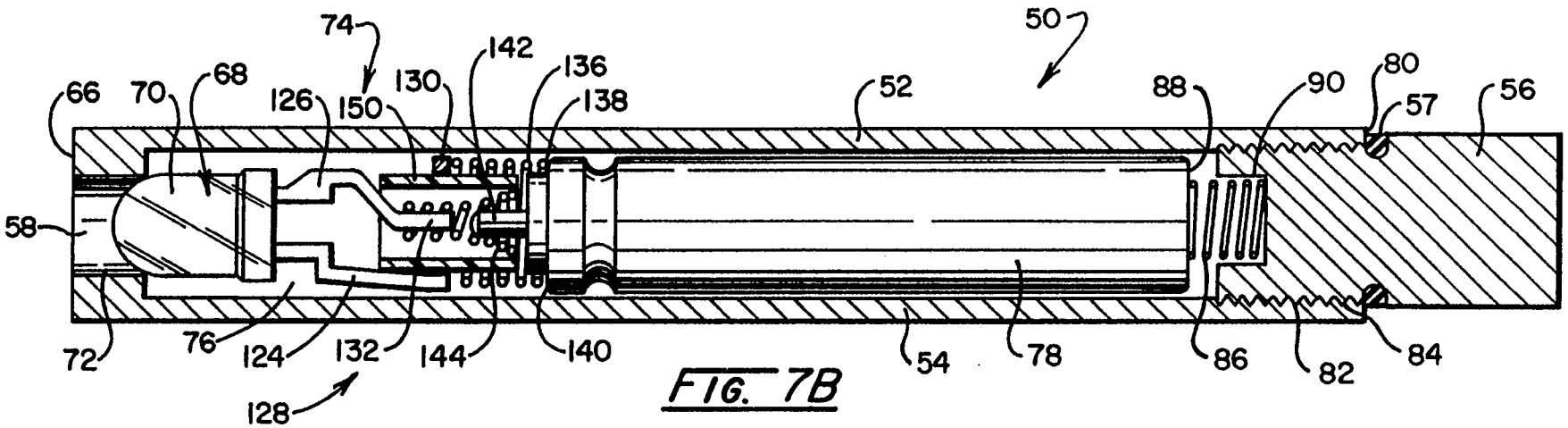

The configuration of the assemblages in FIGS. 7A and 7B is made to accommodate the dynamic shock loading occasioned by the mounting of apparatus 50 at the end of a firearm. Because of these shocks, an insulation or isolating component has been found desirable with respect to an assured isolation of the capture spring 144 from a potential short circuit with the switching component spring 136. This is achieved, for example, by the insertion of an electrically insulative polymeric cylindrical collar 150 between them. Additionally, it has been found desirable to provide a contact pressure bias of a continuous nature against the battery 78 through the utilization of the compression spring 86.

Figure 8:
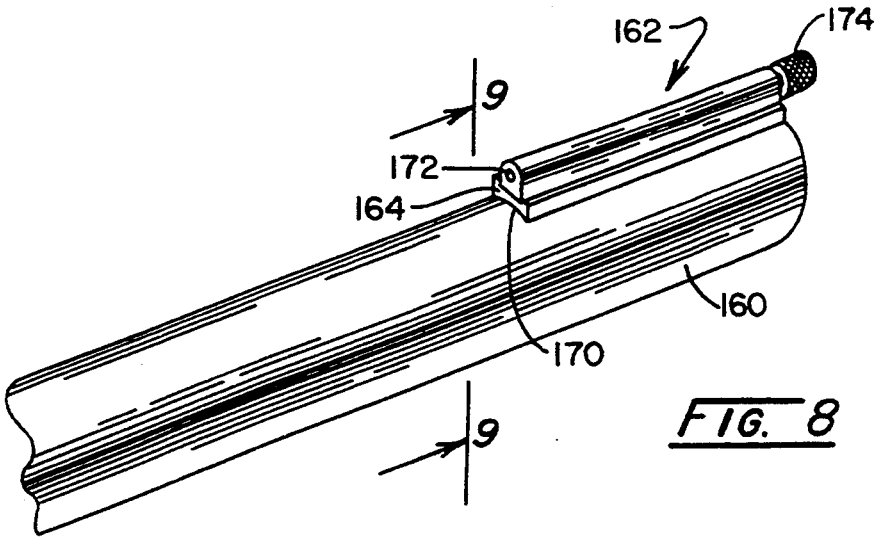
FIG. 8 is a perspective view of a shotgun barrel upon which another embodiment of sighting apparatus according to the invention is mounted.
Figure 9:
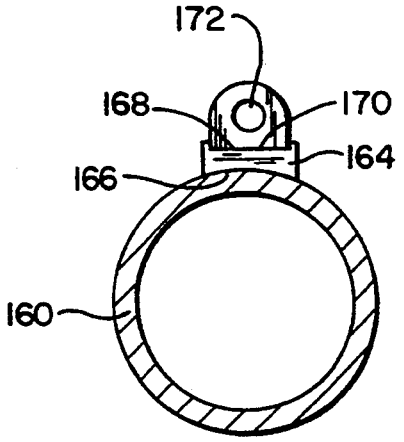
FIG. 9 is a sectional view of the barrel and apparatus of FIG. 8 taken through the plane 9—9 shown therein.

Turning to FIGS. 8 and 9, an adaptation of the sight apparatus 50 to a rounded barrel tip as at 160 is revealed. For this embodiment, the sight apparatus 162 is configured in the same manner as described earlier herein in general at 50. However, to accommodate for the upper curved surface of the bell 160, an insert 164 is provided which, as seen in FIG. 9, is curved about its bottom surface 166 and is formed having a flat, wide grooved upper portion 168 for receiving the flat bottom surface 170 of sight apparatus 162. As before, the apparatus 162 includes an exit aperture 172 and a knurled knob switching component 174. Knob 174 carries out the same function as discussed in conjunction with knob 56.

Figure 10:
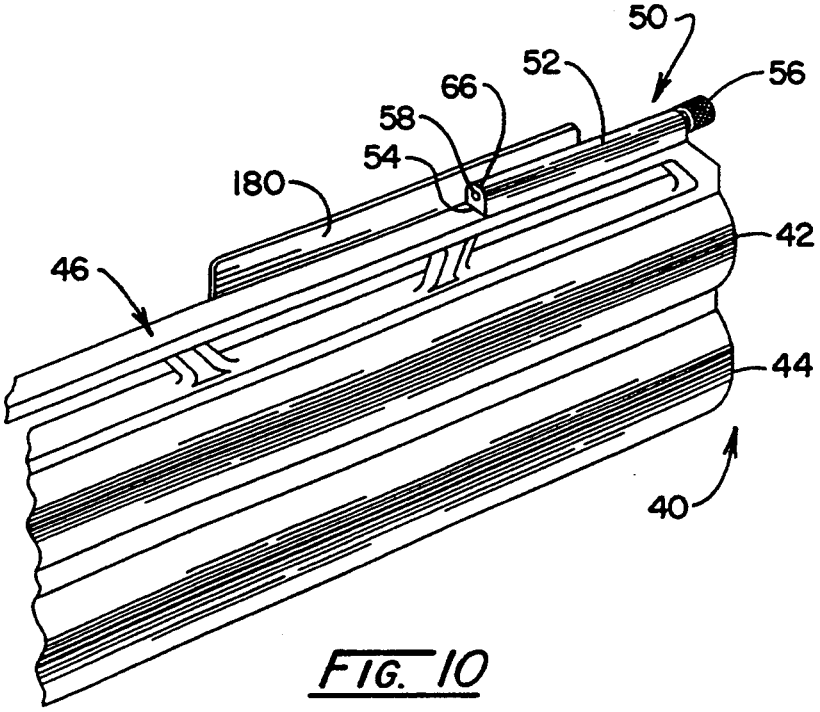
FIG. 10 is a partial perspective view of the sight apparatus and gun barrels shown in FIG. 1 with the addition of a sight blocking assemblage

As is apparent from the foregoing, one salient aspect of the sight apparatus 50 resides in encouragement of the shooter to maintain both eyes open and focused at infinity in the course of firing at remote moving targets. The sight apparatus of the invention has a particularly useful contribution to those more unfortunate shooters who must perform under conditions of opposite-eye dominance. That is, a right-handed shooter who is left-eye dominant has substantial difficulty in shooting with both eyes open. Youngsters initially introduced to shooting training generally will be given a simple test to determine the presence or absence of an eye dominance. Where rifles are concerned, the youngster simply is taught to fire with the handedness associated with the dominant eye. That arrangement generally is not available for shotgun shooting and the like. However, the sight apparatus of the present invention may be combined with an isolating or sight blocking arrangement mountable with the sight and extending along the sight axis. Such device may be utilized to restrict the view of the light output from exit aperture 58 so as to insure front sight perception only with the shooter's eye position aligned with the sight axis. Thus, without front sight reference, the otherwise dominant eye is forced to look forward to the target and focused at infinity. Looking to FIG. 10, one simple arrangement for this is illustrated. In the figure, all of the common components described in conjunction with FIG. 2 are again reproduced with the same numerical identification. However, the barrel tip region 40 of FIG. 10 includes a sight blocking vane 180 positioned on the left side of it and extending inwardly towards the shooter's eye position from exit aperture 58. This vane may be, for example, formed of a light opaque material and rise approximately $\frac{5}{8}$ of an inch above the rib or ramp of the gun barrel. Thus, for a left eye dominant shooter, who is right handed as will be the case with the arrangement of FIG. 10, the left eye cannot see the front sight and is thus forced to focus forward to the target. Other more elaborate techniques can be utilized to achieve this correction, for example, through the expedient of columnating the output of the exit aperture 58 further down the barrel with a protective hood or the like. Vane 180 also can be used with conentional bead sights but without the substantially improved results otherwise achieved with the sight apparatus 50.

Since certain changes may be made in the above described apparatus and method without departing from the scope of the invention herein involved, it is intended that all matter contained in the description thereof or shown in the accompanying drawings shall be interpreted as illustrative and not in a limiting sense.

It is claimed:

1. A sight assembly generally located at a forwardly disposed tip region of a firearm for use by opposite-eye-dominant shooters having a dominant eye line of sight when said firearm is at a shooter-eye-position comprising:

a front sight apparatus located at said tip region of said firearm; and blocking means mountable upon said firearm for restricting a view of said front sight apparatus from said dominant eye line of sight of said opposite-eye-shooter when said firearm is at said shooter-eye-position.

2. The sight assembly of claim 1 in which said blocking means comprises a thin, vertically disposed vane mountable to said barrel of said firearm, extending along said barrel adjacent to said front sight apparatus.

3. The sight assembly of claim 1, in which said blocking means comprises a thin, vertically disposed vane mounted upon said sight apparatus, extending along said barrel adjacent to said front sight apparatus.

4. The sight assembly of claim 3, in which said vane rises about $\frac{5}{8}''$ above said barrel of said firearm.

* * * * *